United States Patent [19]

Gillespie

[11] Patent Number: 4,656,746

[45] Date of Patent: Apr. 14, 1987

[54] BOWSTRING-MOUNTED AIMING SIGHT

[76] Inventor: Mark E. Gillespie, Box 74 Allen Fork Route, Sissonville, W. Va. 25320

[21] Appl. No.: 851,541

[22] Filed: Apr. 14, 1986

[51] Int. Cl.[4] ..... F41B 5/00

[52] U.S. Cl. ..... 33/265; 124/87

[58] Field of Search ..... 33/265; 124/87, 90

[56] References Cited

U.S. PATENT DOCUMENTS

| | | | |
|---|---|---|---|
| 3,199,502 | 8/1965 | Stonecipher | 33/265 |
| 3,410,644 | 11/1968 | McLendon | 33/265 |
| 3,703,770 | 11/1972 | Sofield | 33/265 |
| 3,703,771 | 11/1972 | Saunders | 33/265 |
| 3,859,733 | 1/1975 | Chesnick | 33/265 |
| 4,011,853 | 3/1977 | Fletcher | 33/265 X |
| 4,116,194 | 9/1978 | Topel | 33/265 X |

*Primary Examiner*—Harry N. Haroian

*Attorney, Agent, or Firm*—Norman B. Rainer

[57] ABSTRACT

A rear peep-sight aiming device is pivotably mounted upon the bowstring of a bow having a forward aiming sight. The sight device may also have an open notch aiming sight. A weighted counterbalance causes the device to automatically swing by gravity effect to a vertical sighting plane. The construction of the device facilitates use by left and right-handed archers.

10 Claims, 3 Drawing Figures

BOWSTRING-MOUNTED AIMING SIGHT

BACKGROUND OF THE INVENTION

This invention concerns an aiming device for an arching bow, and more particularly relates to a bowstring-mounted rear sight intended for use in conjunction with a bow-mounted front sight.

The prior art is replete with devices which have sought to improve archery techniques. In the construction of archery bows, it has been customary to equip the bowstring with both a nocking point, and a peep sight spaced a predetermined distance above the nocking point and in the archer's line of sight. The nocking point assures consistent positioning of each arrow at the same point along the bowstring. The peep or rear sight enables the archer to precisely align the bowstring with a front sight mounted upon the bow adjacent its handle portion.

A problem with the sights which are disclosed in the prior art arises when the bowstring is drawn rearwardly. During the rearward pull of the bowstring, a string-mounted rear sight may rotate about the string axis, thereby becoming misaligned with respect to the archer's sight toward the target.

In order to overcome the rotation problem, rear sight devices have been disclosed, such as in U.S. Pat. No. 4,116,194, which utilize a length of elastic lanyard extending between the bow and rear sight. In such instances, the rear sight is fixed with respect to the string, and the force exerted by the lanyard must be strong enough to affect twisting rotation of the bowstring. Although the lanyard causes the bow and peep sight to be in substantially coplanar alignment, it does not ensure that said plane of alignment is a consistently vertical plane. Also, the elastic material of the lanyard degrades in time, thereby reducing its effectiveness. In some instances, the lanyard may interfere with the loading of an arrow upon the bow.

Other problems encountered in the use of rear peep sights are poor visibility through the peep aperture and slowness of use, such problems being essentially the same as those encountered with rear rifle sights. Prior to this invention, the disadvantages of rear or peep sights generally outweighed the potential for greater accuracy, especially under conditions of low light and the need for quick aiming. Rear, string-mounted bow sights of conventional design are generally capable of only peep sight design, being incapable of use in the manner of an open notch rear sight.

It is accordingly an object of the present invention to provide a string-mounted bow sight unaffected by rotation of the bowstring and alignable with a front sight associated with the bow.

It is another object of this invention to provide a bow sight as in the foregoing object having either peep sight or open notch design, or both incorporated into the same sight.

It is a further object of the present invention to provide a bow sight of the aforesaid nature which does not require separate means connecting it to the bow.

It is still another object of this invention to provide a bow sight of the aforesaid nature of rugged, durable design and amenable to low cost manufacture.

These objects and other objects and advantages of the invention will be apparent from the following description.

SUMMARY OF THE INVENTION

The above and other beneficial objects and advantages are accomplished in accordance with the present invention by a bowstring-mounted aiming sight device comprising:

(a) a sight body assembly comprised of:

(1) a bifurcated rigid frame having upper, lower, front and rear extremities, and facing left and right side panels having interior and exterior surfaces, and rear extremity having a circular cylindrical channel extending between said upper and lower extremities, said opposed side panels being apertured to receive joining means, said interior surfaces being flat and planar, and at least one flat sighting panel extending outwardly from said side panels and preferably angled convergently toward the upper extremity of said angle channel such that the angle between said sighting panel and the center axis of said channel is between about 15 and 30 degrees, said sighting panel having a peep aperture and preferably a notch positioned thereabove, (2) a weighted counterbalance disposed between said side panels and extending forwardly of said front extremity, and (3) joining means extending in operative engagement between said opposed side panels and through said counterbalance, and (b) positioning means comprised of a pivot surface which engages said channel, and upper and lower retaining shoulders which maintain the sight body assembly upon the pivot surface while permitting rotative movement thereabout.

In preferred embodiments, the frame of the sight body assembly is an integral monolithic structure. Two sighting panels may be present in symmetrical disposition about said side panels. The distance of separation between the facing interior surfaces of said side panels is preferably such as to permit close-fitting passage of a bow string en route to seated engagement within said channel. The weighted counterbalance preferably has a flat portion which removably occupies the space between said facing interior surfaces and further serves to retain the bowstring within said channel. The joining means may be a threaded bolt, passing through the apertures in said side panels and through the intervening flat portion of the weight counterbalance to maintain said side panels and counterbalance in tightly sandwiched engagement. The pivot surface of the positioning means is preferably comprised of a low friction material such as teflon or other materials to enhance pivotal movement of the sight body assembly. The pivot surface may be a winding or sleeve about the bowstring, or may be part of a short section attached at both extremities to the bow string and thereby constituting an in-line segment of the bow string. An elastic tether of relatively low tension may be utilized with the aiming sight device of this invention; its primary use being to enhance the positioning of the sight at high aiming angles and in high winds.

BRIEF DESCRIPTION OF THE DRAWING

For a fuller understanding of the nature and objects of the invention, reference should be had to the following detained description taken in connection with the accompanying drawing forming a part of this specification and in which similar numerals of reference indicate corresponding parts in all the figures of the drawing.

Figure 3:
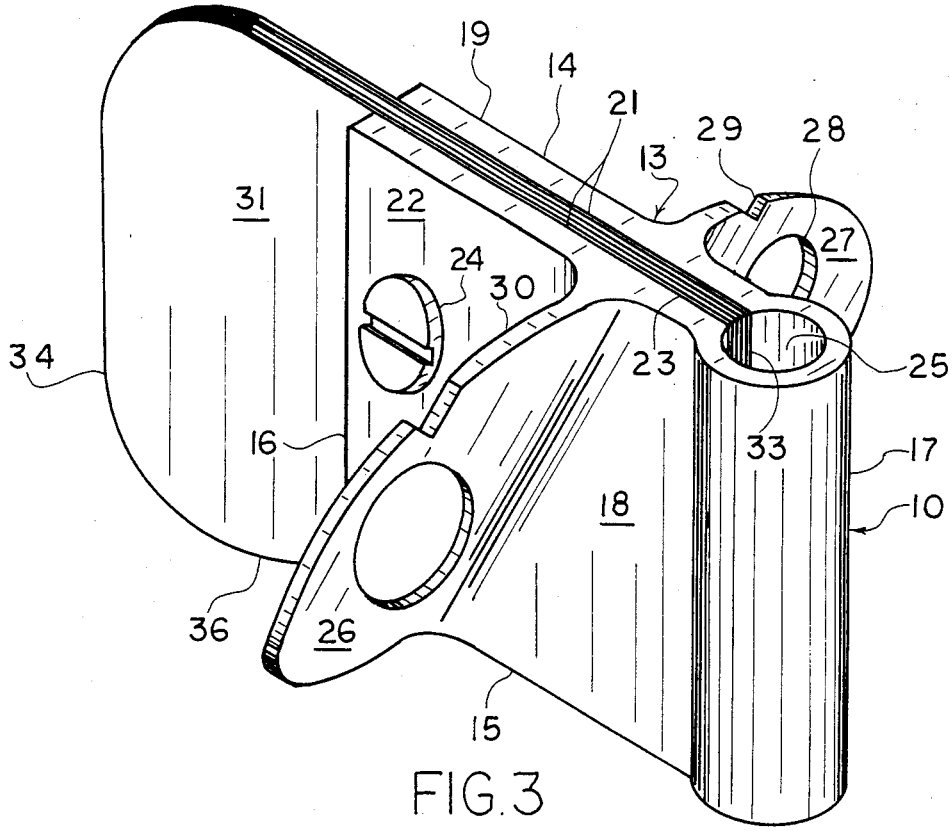
FIG. 3 is a top view of the sight body assembly of FIG. 2.

For convenience of description, the terms "front" and "rear" and expressions of equal import will have reference to the left and right extremities, respectively, of the device as shown in FIG. 3. Similarly, the words "upper" and "lower", and terms equivalent thereto will have reference to the upper and lower portions, respectively, of the device as shown in FIG. 1.

DESCRIPTION OF THE PREFERRED EMBODIMENT

Figure 1:
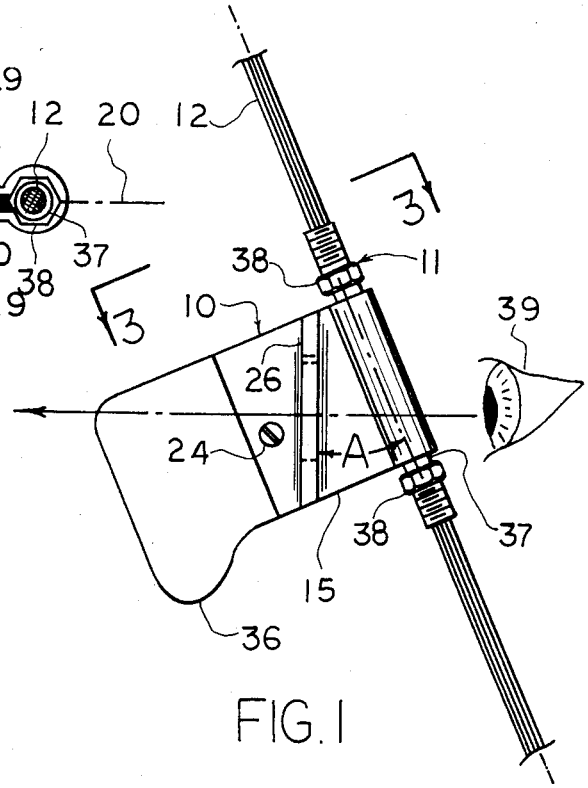
FIG. 1 is a side view of an embodiment of the sight device of this invention shown mounted upon a bowstring depicted in its fully drawn position and illustrating the sighting relationship with the archer's eye.

Referring to FIG. 1, an embodiment of the sight device of the present invention is shown comprised of sight body assembly 10 rotatively emplaced upon positioning means 11 mounted upon bowstring 12.

Figure 2:
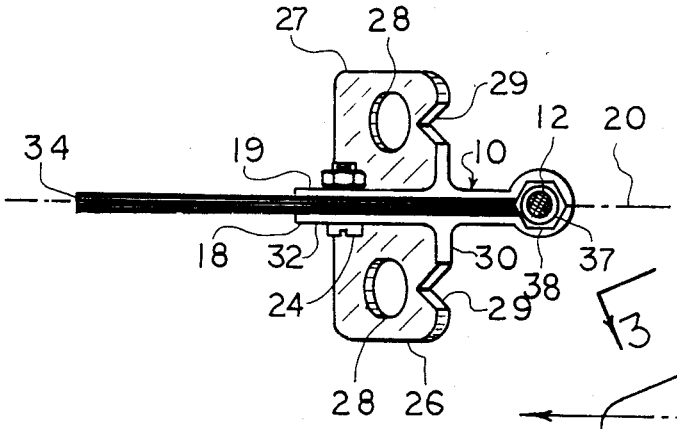
FIG. 2 is an enlarged view of the sight body assembly of the sight device of FIG. 1.

Sight body assembly 10 is comprised of bifurcated rigid frame 13 of monolithic construction having upper, lower, front and rear extremities, 14, 15, 16 and 17, respectively, and left and right side panels 18 and 19, respectively, disposed in facing relationship about a vertically disposed plane of symmetry represented by broken line 20 in FIG. 2. Said side panels have interior and exterior surfaces, 21 and 22, respectively, said facing interior surfaces being flat and defining a slot 23, shown in FIGS. 2 and 3, having uniform width between said front and rear extremities. Apertures 32 are disposed within said side panels to receive joining means in the form of threaded bolt 24. The frame may be fabricated of metal or plastic by machining or molding techniques.

As shown most clearly in FIGS. 2 and 3, a circular cylindrical channel 25 disposed adjacent rear extremity 17 extends perpendicularly between upper extremity 14 and lower extremity 15.

Left and right sighting panels 26 and 27, respectively, extend perpendicularly outward from said left and right side panels, respectively. Said sighting panels are flat and are convergently inclined toward the upper extremity of channel 25. The angle of inclination of the sighting panels is such that they form with the center axis of said channel an angle A, shown in FIG. 1, having a value between about 15 and 30 degrees.

The sighting panels each have a centered peep hole 28, and a notch 29 disposed above the peephole within upper edge 30 of the sighting panel. The peephole can also be located off-center in each sighting panel. Although the notch is shown having a V-shape, other shapes may be employed.

A weighted counterbalance 31 of panel configuration is held within slot 23 by bolt 24 which penetrates said counterbalance. The rear extremity of the counterbalance is a straight edge 33 which constitutes part of the interior sidewall of channel 25. Edge 33 can also be an irregular (toothed) edge to dampen vibration noise. The forward edge 34 of the counterbalance extends in front of front extremity 16 of frame 13, and the lower edge 36 of the counterbalance extends below lower extremity 15 of the frame. The counterbalance is preferably fabricated of rubber.

Positioning means 11 is comprised of a circular cylindrical pivot surface 37 axially aligned with the bowstring and having a diameter such as to make close-fitting engagement within channel 25. The pivot surface may be either a wrapping upon the conventional bowstring, or may be a section which attaches at both extremities to the bowstring and in line therewith. The pivot surface is preferably of teflon or other low-friction composition permitting easy rotation of the sight body assembly thereupon. Paired retaining collars 38, associated with the extremities of the pivot surface, maintain the elevational position of the sight body assembly upon the bowstring.

In use, the sight device is normally installed upon the pivot surface by removing bolt 24 and counterbalance 31, entering the bowstring or pivot surface through slot 23, and then replacing said counterbalance and bolt. The sight assembly is thereby pivotably held by the bowstring, and the gravity activated movement of the counterbalance will cause the sight body assembly to assume a position upon the fully drawn bowstring such that the plane of symmetry is substantially vertically disposed. In such position, the eye of the archer 39 can sight accurately and consistently through the peep hole or notch to align the front bowsight with the target.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A bowstring-mounted aiming sight device comprising:

(a) a sight body assembly comprised of:

(1) a bifurcated rigid frame having upper, lower, front and rear extremities, and facing side panels having interior and exterior surfaces, said rear extremity having a circular cylindrical channel extending between said upper and lower extremities, said interior surfaces being flat and in parallel juxtaposition, and at least one flat sighting panel extending outwardly from the exterior surface of a side panel, said sighting panel having a peep aperture, (2) a weighted counterbalance positioned between said side panels and extending forwardly of said front extremities, and (3) joining means extending in operative engagement between said opposed side panels and through said counterbalance, and (b) positioning means comprised of a pivot surface which engages said channel, and upper and lower retaining shoulders which maintain the sight body assembly upon the pivot surface while permitting rotative movement thereabout.

2. The device of claim 1 wherein a sighting panel extends outwardly from each exterior surface of the side panels in opposed disposition about a plane of symmetry parallel to said side panels and centered therebetween.

3. The device of claim 2 wherein said sighting panels are angled toward the upper extremity of said channel such that the angle between said sighting panels and the center axis of said channel is between about 15 and 30 degrees.

4. The device of claim 2 wherein a sighting notch is positioned above the peep aperture in each sighting panel.

5. The device of claim 1 wherein said frame is an integral monolithic structure.

6. The device of claim 1 wherein the distance of separation between the facing interior surfaces of said side panels is such as to permit close-fitting passage of a bow string.

7. The device of claim 1 wherein the weighted counterbalance has a flat portion which removably occupies the space between said facing interior surfaces of said side panels, and serves to retain the bowstring within said channel.

8. The device of claim 7 wherein the joining means is a threaded bolt which passes through apertures in said side panels and through the intervening flat portion of said weighted counterbalance to maintain said side panels and counterbalance in tightly sandwiched engagement.

9. The device of claim 1 wherein the pivot surface is comprised of a low friction material.

10. The device of claim 9 wherein said low friction material is teflon.

* * * * *